US009640911B2

(12) United States Patent
Chen et al.

(10) Patent No.: US 9,640,911 B2
(45) Date of Patent: May 2, 2017

(54) PLUG CONNECTOR WITH CAPABILITY OF DUAL MATING ORIENTATION

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Fu-Yi Xu, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/919,745

(22) Filed: Oct. 22, 2015

(65) Prior Publication Data

US 2016/0134056 A1 May 12, 2016

(30) Foreign Application Priority Data

Nov. 6, 2014 (CN) ..... 2014 1 0618574

(51) Int. Cl.

| | |
|---|---|
| ***H01R 24/00*** | (2011.01) |
| ***H01R 13/642*** | (2006.01) |
| ***H01R 24/60*** | (2011.01) |
| *H01R 107/00* | (2006.01) |

(52) U.S. Cl.

CPC ..... *H01R 13/642* (2013.01); *H01R 24/60* (2013.01); *H01R 2107/00* (2013.01)

(58) Field of Classification Search

CPC ..... H01R 23/02; H01R 24/60; H01R 24/62
USPC ..... 439/660, 607.41, 607.4, 607.1, 357
See application file for complete search history.

(56) References Cited

U.S. PATENT DOCUMENTS

| | | | | |
|---|---|---|---|---|
| 7,094,089 | B2 * | 8/2006 | Andre | H01R 12/7088 439/218 |
| 7,488,188 | B2 * | 2/2009 | Moriyama | H01R 13/26 439/108 |
| 9,142,926 | B2 * | 9/2015 | Tsai | H01R 24/60 |
| 2012/0015561 | A1 | 1/2012 | Tsai | |
| 2012/0302076 | A1 * | 11/2012 | Tsai | H01R 12/724 439/131 |
| 2014/0335729 | A1 * | 11/2014 | Little | H01R 24/60 439/607.53 |

(Continued)

FOREIGN PATENT DOCUMENTS

| | | | |
|---|---|---|---|
| CN | 201252183 | Y | 6/2009 |
| CN | 103779697 | A | 5/2014 |
| TW | M508812 | U | 9/2015 |

*Primary Examiner* — Phuong Dinh
(74) *Attorney, Agent, or Firm* — Winston Hsu; Scott Margo

(57) ABSTRACT

A plug connector includes a plug shell, a housing base and a plug contact. The housing base is combined with the plug shell and includes a main base and a tongue structure. The tongue structure extends from the main base and has a first face and a second face opposite to the first face. The plug contact includes a main body, a foot portion, a first end portion and a second end portion. The main body is mounted in the main base. The foot portion extends from the main body and stretches out of the main base. The first end portion is resiliently connected to the main body and protrudes out of the tongue structure via the first face. The second end portion corresponding to the first end portion is resiliently connected to the main body and protrudes out of the tongue structure via the second face.

20 Claims, 12 Drawing Sheets

(56) References Cited

U.S. PATENT DOCUMENTS

2015/0270646 A1* 9/2015 Kao ..... H01R 13/6581
439/76.1
2016/0134055 A1* 5/2016 Chen ..... H01R 12/722
439/217

* cited by examiner

PLUG CONNECTOR WITH CAPABILITY OF DUAL MATING ORIENTATION

BACKGROUND OF THE INVENTION

1. Field of the Invention

The present invention relates to a connector, and more particularly, to a plug connector adapted to a Universal Serial Bus interface and with capability of dual mating orientation.

2. Description of the Prior Art

With development of computer and peripheral equipment industry, a Universal Serial Bus (USB) interface has become one of important interfaces for communication and data transmission between a computer and peripheral equipment. A USB connector usually has a specified orientation when mating, i.e., a tongue of a USB male connector and a USB female connector are staggered, such that the tongue of the USB male connector is able to be inserted into a socketing space surrounded by a metal shell of the USB female connector. It ensures that the USB male connector is inserted into the female connector properly and that terminals of the USB male connector are electrically connected to terminals of the USB female connector, which achieves a purpose of communication and data transmission. In other words, the conventional USB connector has only single mating orientation. As a result, the USB male connector and the USB female connector have to be oriented before mating, such that the USB male and female connectors are able to be coupled each other. In such a way, the conventional USB connector is not convenient in use.

SUMMARY OF THE INVENTION

Thus, the present invention provides a plug connector adapted to a Universal Serial Bus interface and with capability of dual mating orientation for solving above drawbacks.

According to the claimed invention, a plug connector with capability of dual mating orientation includes a plug shell, a housing base and a plug contact set. The housing base is combined with the plug shell, and the housing base includes a main base and a tongue structure. The tongue structure extends from the main base and has a first face and a second face opposite to the first face. The plug contact set is mounted with the housing base, and at least one of the plug contact set includes a main body, a foot portion, a first end portion and a second end portion. The main body is installed inside the main base. The foot portion extends from the main body and stretches out of the main base. The first end portion is resiliently connected to the main body and stretches out of the tongue structure via the first face. The second end portion corresponding to the first end portion is resiliently connected to the main body and stretches out of the tongue structure via the second face.

According to the claimed invention, an accommodating space is surrounded by the plug shell, an accommodating opening is defined by a front edge of the plug shell. The plug connector further includes an insulation housing disposed inside the plug shell, and the insulation housing includes a body portion and a window flange. The body portion is installed in the accommodating space via the accommodating opening, and an inner socketing space is surrounded by the body portion. The inner socketing space accommodates the tongue structure and the plug contact set, and an edge of the body portion defines a window. The window flange is disposed on the edge of the body portion and protrudes from the window, and the window flange covers the front edge of the plug shell.

According to the claimed invention, a resiliently engaging arm is formed on the body portion, the resiliently engaging arm engages with a port connector, and the body portion and the resiliently engaging arm are integrally formed.

According to the claimed invention, a housing assembling slot is formed on the body portion, and the plug connector further includes a resiliently engaging member installed in the housing assembling slot and resiliently engaging with a port connector.

According to the claimed invention, a through slot is formed on the main base, and the resiliently engaging member includes an engaging body, an engaging portion and a fixing portion. The engaging body is mounted in the housing assembling slot. The engaging portion extends from the engaging body and engages with the port connector. The fixing portion extends from the engaging body and is located opposite to the engaging portion. The fixing portion passes through the main base via the through slot, stretches out of the main base and is located on the same side with the foot portion.

According to the claimed invention, the resiliently engaging member further includes at least one embedding structure protruding from the engaging body and embedding in a lateral wall of the housing assembling slot.

According to the claimed invention, an engaging slot is formed on the body portion, the plug shell has an engaging protrusion, and the engaging protrusion is engaged in the engaging slot.

According to the claimed invention, the plug shell is integrally formed in a metal injection molding manner or in a zinc alloy die manner.

According to the claimed invention, the plug shell is integrally formed in a draw manner. An accommodating space is surrounded by the plug shell and accommodates the housing base and the tongue structure. An accommodating opening is defined by a front edge of the plug shell, and an opening flange is formed on the front edge of the plug shell and covers an edge of the tongue structure of the housing base.

According to the claimed invention, a tongue assembling slot is formed on the tongue structure of the housing base, and the plug connector further includes a resiliently engaging member installed in the tongue assembling slot and resiliently engaging with a port connector.

According to the claimed invention, a passage is formed on the main base and communicates with the tongue assembling slot, and the resiliently engaging member includes an engaging body, an engaging portion and a fixing portion. The engaging body is mounted in the tongue assembling slot. The engaging portion extends from the engaging body and engages with the port connector. The fixing portion extends from the engaging body and is located opposite to the engaging portion. The fixing portion passes through the main base via the passage, stretches out of the main base and is located on the same side with the foot portion.

According to the claimed invention, the resiliently engaging member further includes at least one embedding structure protruding from the engaging body and embedding in a lateral wall of the tongue assembling slot.

According to the claimed invention, an assembling slot is formed on the main base, and the main body is installed in the assembling slot. A first slot is formed on the first face of the tongue structure, and a second slot is formed on the second face of the tongue structure. The assembling slot communicates with the first slot and the second slot. The at least one plug contact includes a first spring arm and a second spring arm. The first spring arm connects the first end portion and the main body, and the first spring arm is disposed in the first slot. The second spring arm connects the second end portion and the main body, and the second spring arm is disposed in the second slot.

According to the claimed invention, a partition structure is defined by a bottom surface of the first slot, a bottom surface of the second slot and a lateral wall of the assembling slot. A clamping slot is defined between the first spring arm and the second spring arm. When the main body is installed in the assembling slot, the first spring arm enters and is accommodated in the first slot via the assembling slot. The second spring arm enters and is accommodated in the second slot via the assembling slot. The clamping slot clamps the partition structure.

According to the claimed invention, the main body has at least one engaging spur, and the at least one engaging spur engages with a lateral wall of the assembling slot when the main body is installed in the assembling slot.

According to the claimed invention, the at least one embedding structure is selectively disposed on a side of the main body or on two opposite sides of the main body.

According to the claimed invention, the plug shell has a fixing lug whereon an engaging structure is formed. A holding structure is formed on the main base of the housing base, and the engaging structure engages with the holding structure.

According to the claimed invention, the two adjacent foot portions are respectively corresponding to the first face and the second face of the tongue structure. The plug shell further has a fixing pin protruding from the fixing lug. The fixing pin and each of the foot portions are respectively fixed on a circuit board.

According to the claimed invention, each of the foot portions includes a first pin and a second pin. A pin slot is defined between the first pin and the second pin. The pin slot clamps an edge of a circuit board.

According to the claimed invention, a base slot is formed on the main base of the housing base, and the base slot and the pin slot cooperatively clamp the edge of the circuit board.

In summary, the main body, the first spring arm, the first end portion, the second spring arm and the second end portion of the plug contact of the present invention are an integrally-formed fork structure. Accordingly, when the port contact is mounted with the housing base, the first end portion and the second end portion of the plug contact respectively stretch out of the tongue structure of the housing base and face to each other, such that the plug connector of the present invention is capable of dually mating with an external connector for enhancing convenience in use.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
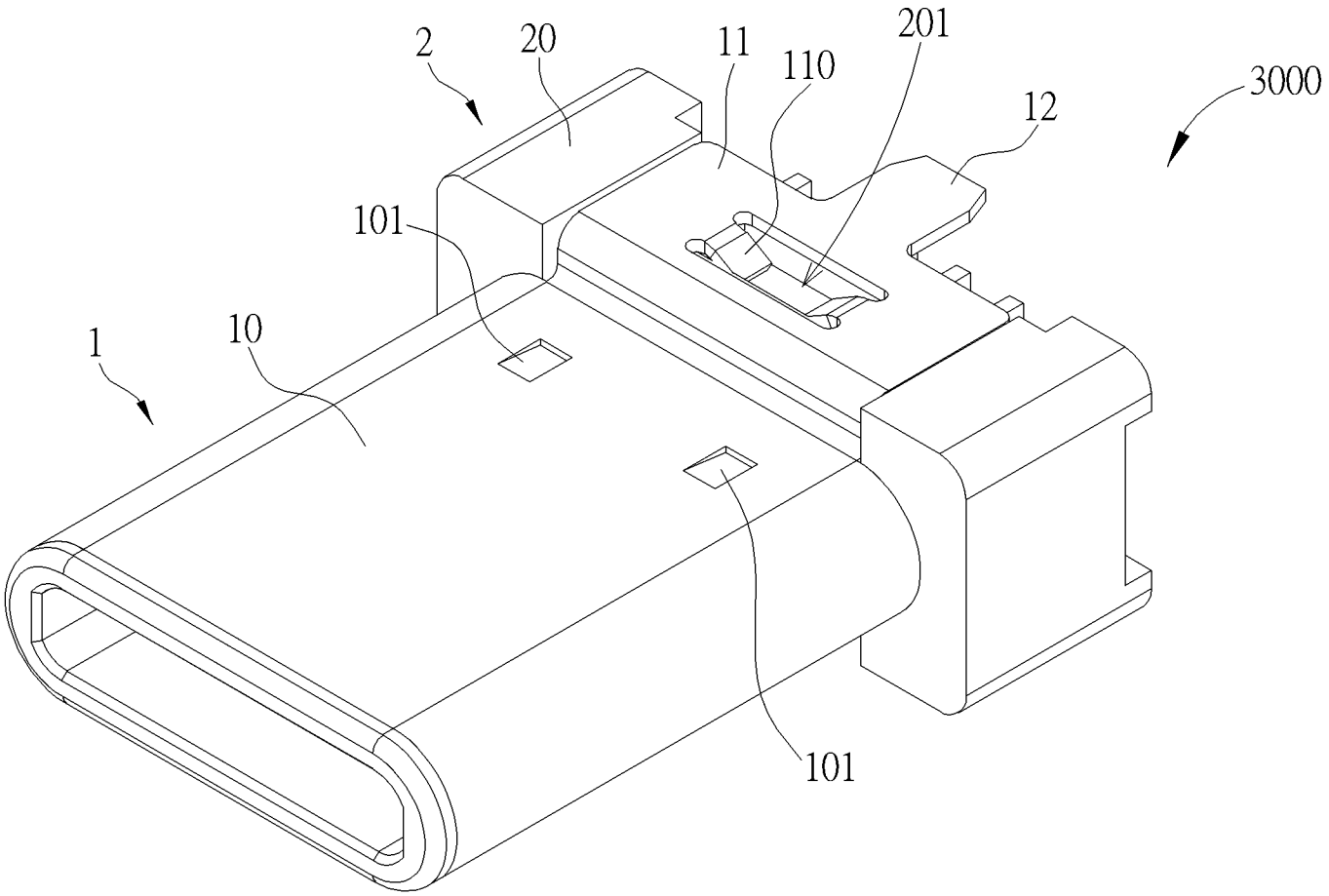
FIG. 1 is a diagram of a plug connector according to a first embodiment of the present invention.
Figure 2:
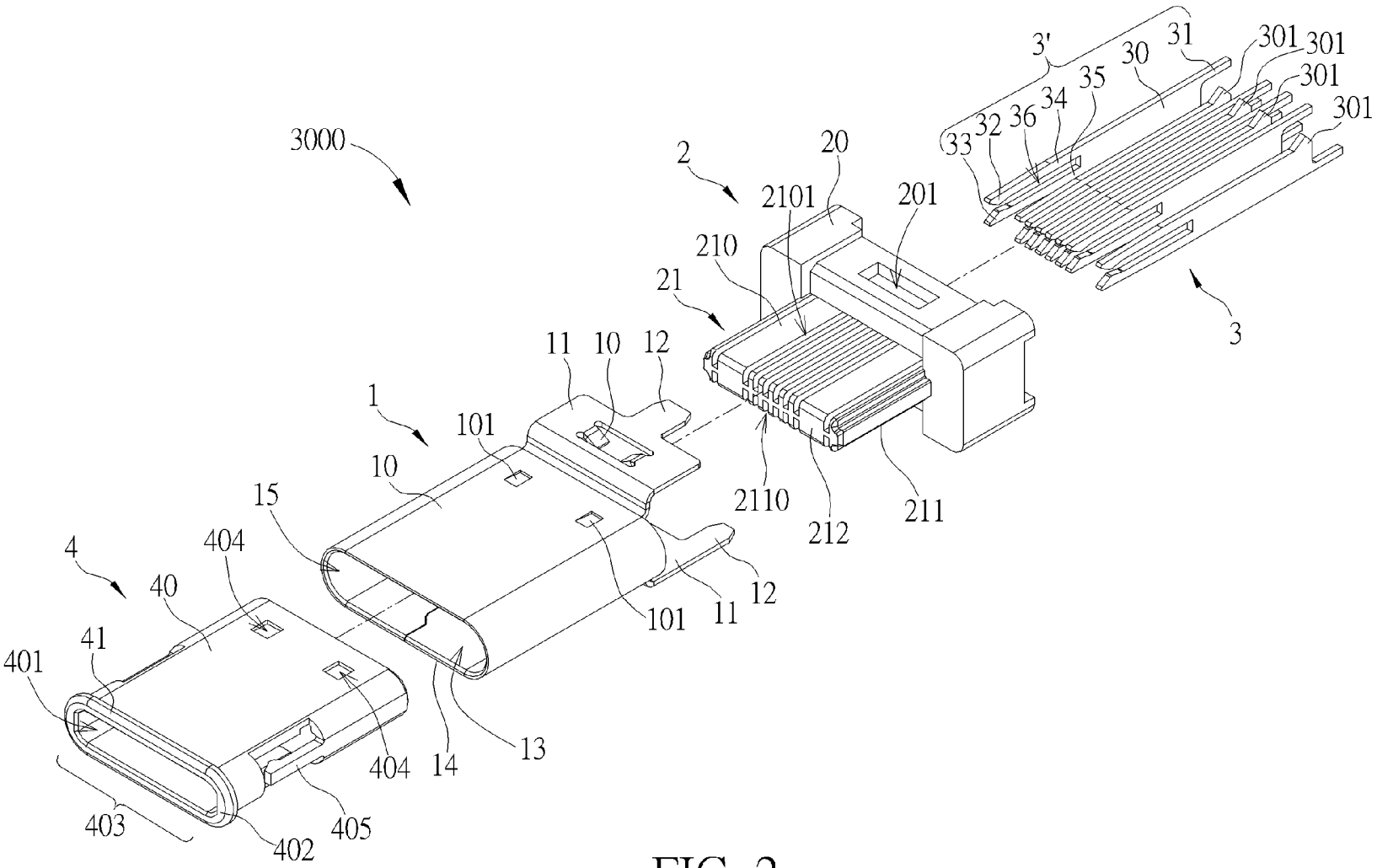
FIG. 2 is an exploded diagram of the plug connector according to the first embodiment of the present invention.
Figure 3:
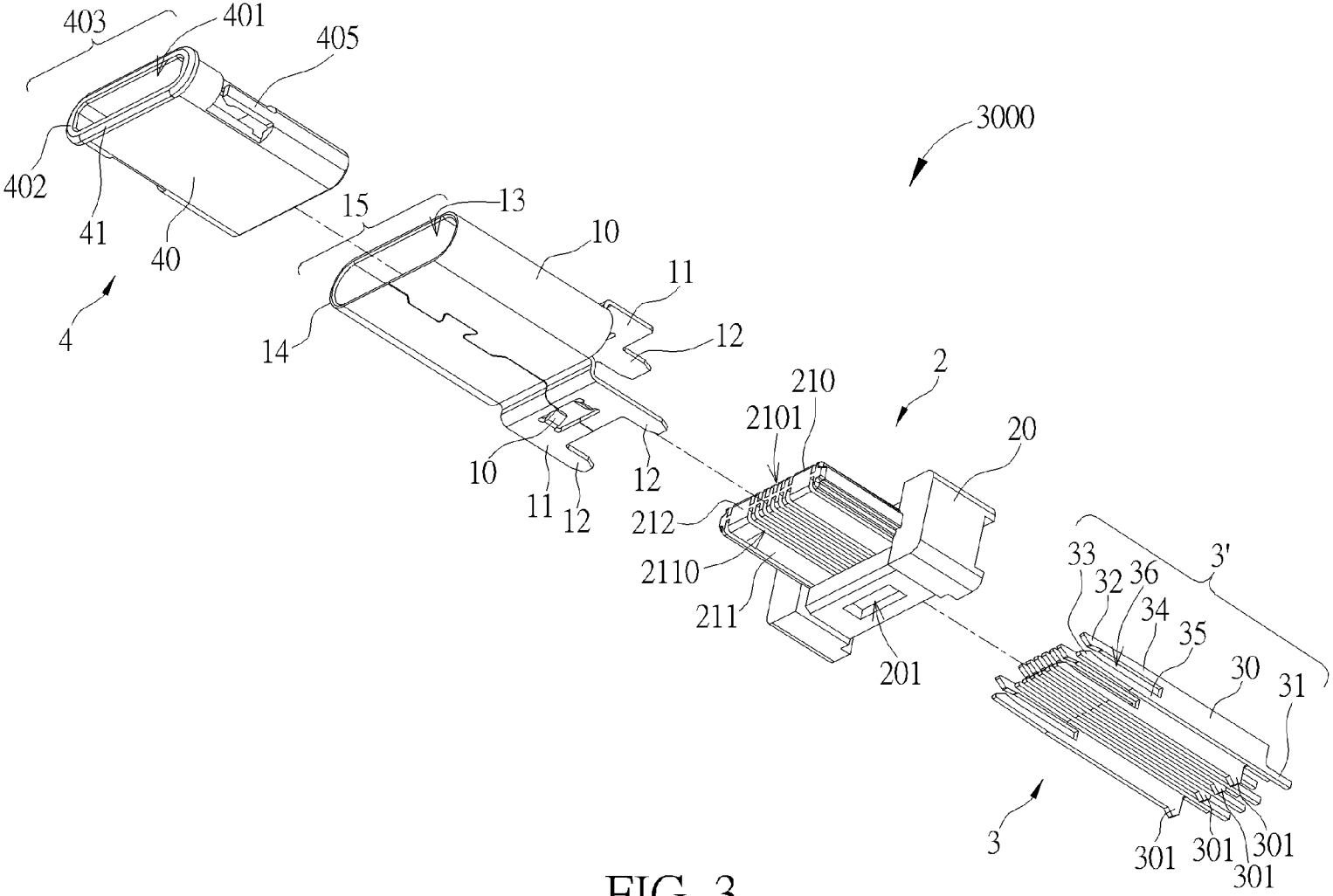
FIG. 3 is an exploded diagram of the plug connector in another view according to the first embodiment of the present invention.

Please refer to FIG. 1 to FIG. 3. FIG. 1 is a diagram of a plug connector 3000 according to a first embodiment of the present invention. FIG. 2 is an exploded diagram of the plug connector 3000 according to the first embodiment of the present invention. FIG. 3 is an exploded diagram of the plug connector 3000 in another view according to the first embodiment of the present invention. As shown in FIG. 1 to FIG. 3, the plug connector 3000 includes a plug shell 1, a housing base 2, a plug contact set 3 and an insulation housing 4. The housing base 2 is combined with the plug shell 1 and includes a main base 20 and a tongue structure 21. The tongue structure 21 extends from the main base 20 and has a first face 210 and a second face 211 opposite to the first face 210. The plug contact set 3 is mounted with the housing base 2, and the insulation housing 4 is disposed inside the plug shell 1.

In this embodiment, the plug contact set 3 includes eight plug contacts 3', which are two grounding contacts, two power contacts, two signal detecting contacts and two signal contacts. The number and type of the plug contact 3' are not limited to those illustrated in this embodiment and it depends on practical demands. Furthermore, the plug contact 3' is a male contact formed by stamping, i.e., the plug connector 3000 of the present invention is a male connector. Besides, the plug shell 1 is made of metal material, and the housing base 2 is made of plastic material. The housing base 2 is for fixing the plug contact set 3 inside the plug shell 1 and insulate each of the plug contacts 3' of the plug contact set 3 from the plug shell 1, so as to prevent each of the plug contacts 3' and the plug shell 1 made of metal from forming a short circuit.

Furthermore, the plug shell 1 includes a main body 10 and two fixing lugs 11. An engaging structure 110 is formed on the fixing lugs 11, respectively, and a secure structure 201 is formed on the main base 20 of the housing base 2. During assembling the plug shell 1 and the housing base 2, the engaging structure 110 is for engaging with the secure structure 201 for combining the housing base 2 with the plug shell 1. In practical application, the fixing lug 11 and the main body 10 can be integrally formed by stamping, the engaging structure is a stamping bending structure, the secure structure 201 is a slot, but the present invention is not limited thereto.

In addition, the plug shell 1 further includes three fixing pins 12 protruding from the fixing lug 11. In practical application, the fixing pins 12 are respectively fixed on a circuit board (not shown in figures) for combining the plug shell 1 and the housing base 2 combined with the plug shell 1 with the circuit board. The number and configuration of the fixing slug 11 are not limited to those illustrated in figures in this embodiment. For example, the plug shell 1 can includes only one fixing lug 11 i.e., structures that the plug shell 1 includes at least one fixing lug 11 are within the scope of the present invention. In practical application, the fixing lug 11 and the main body 10 are integrally formed in a stamping manner, but the present invention is not limited thereto.

Figure 4:
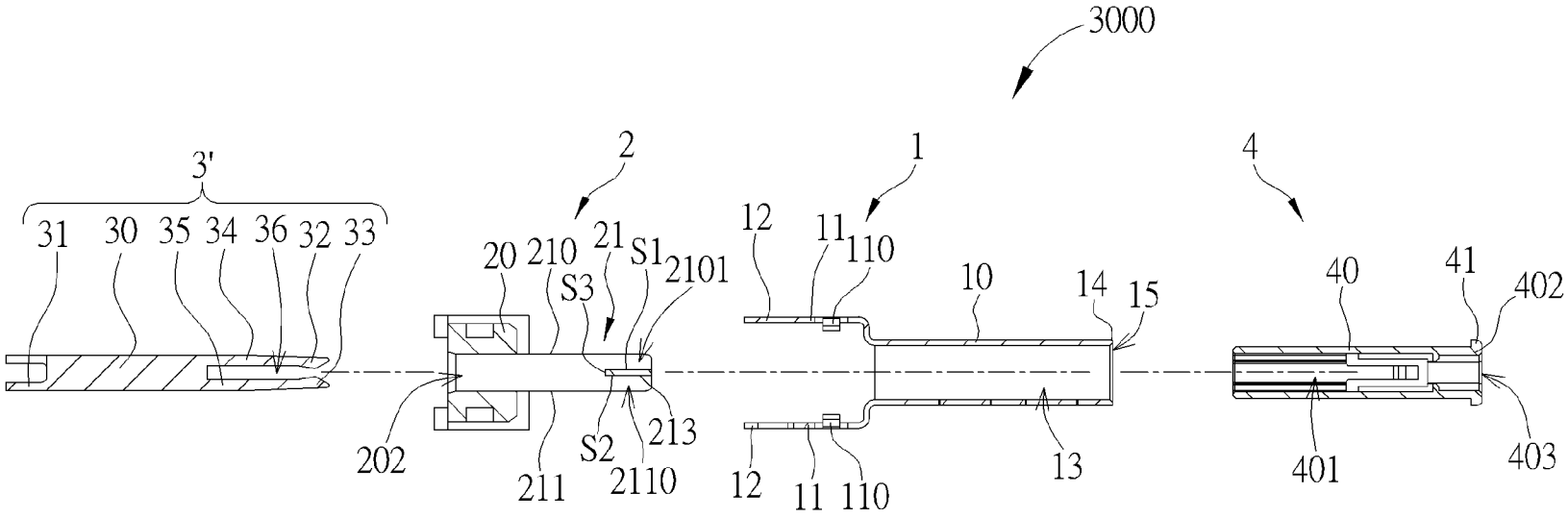
FIG. 4 is an exploded sectional diagram of the plug connector according to the embodiment of the present invention.
Figure 5:
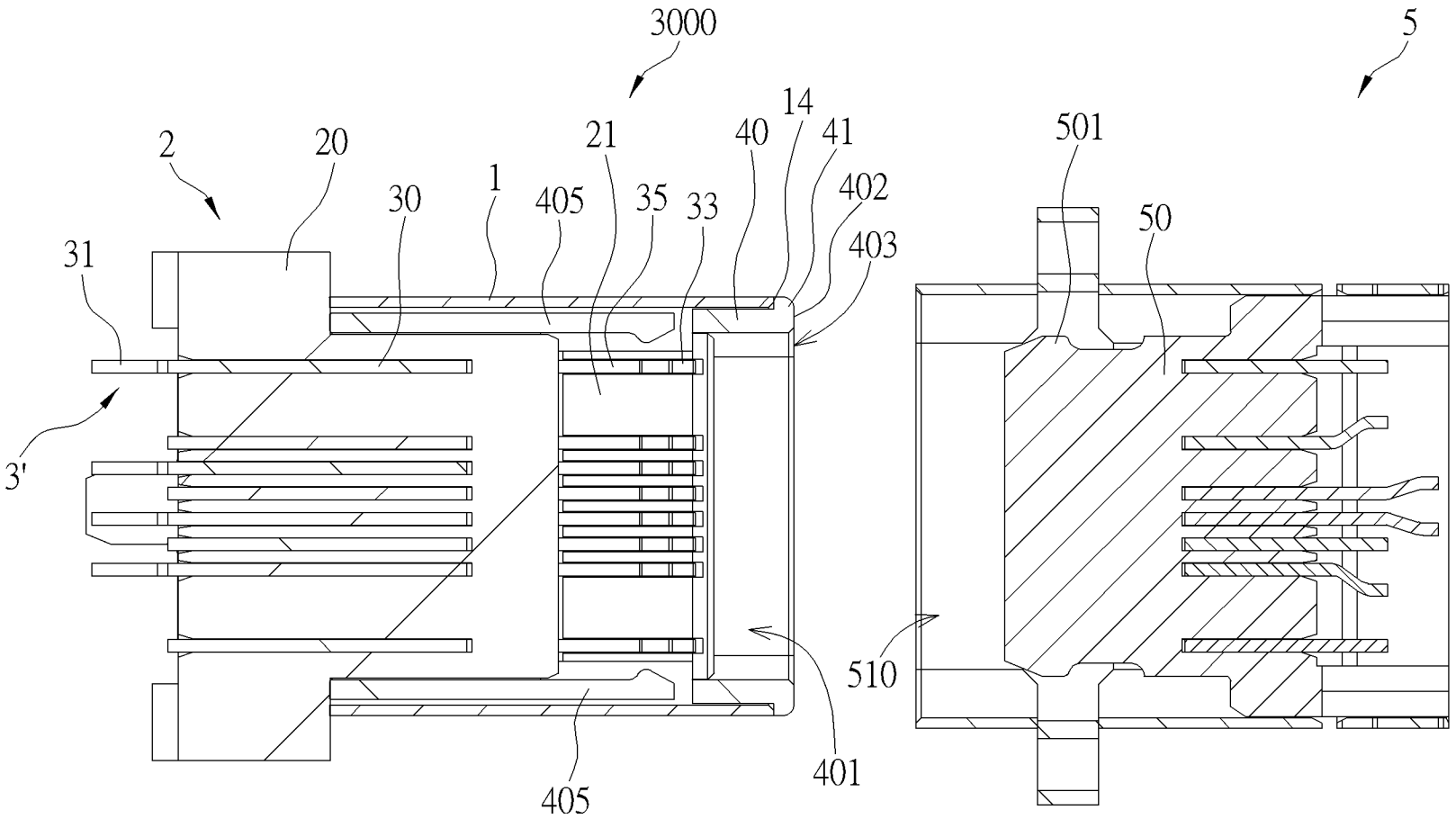
FIG. 5 is a sectional diagram of the plug connector in a non-mated status according to the embodiment of the present invention.

Please refer to FIG. 2 to FIG. 5. FIG. 4 is an exploded sectional diagram of the plug connector 3000 according to the embodiment of the present invention. FIG. 5 is a sectional diagram of the plug connector 3000 in a non-mated status according to the embodiment of the present invention. As shown in FIG. 2 to FIG. 5, an accommodating space 13 is surrounded by the plug shell 1, and an accommodating opening 15 is defined by a front edge 14 of the plug shell 1. The accommodating space 13 communicates with exterior of the plug shell 1 via the accommodating opening 15. Furthermore, the insulation housing 4 includes a body portion 40 and a window flange 41. An inner socketing space 401 is surrounded by the body portion 40, and the inner socketing space 401 accommodates the tongue structure 21 of the housing base 2 and the plug contact set 3 mounted with the housing base 2. An edge 402 of the body portion 40 defines a window 403, as shown in FIG. 2 to FIG. 4.

Furthermore, the window flange 41 is disposed on the edge 402 of the body portion 40 and protrudes from the window 403 along a direction perpendicular to the window 403. When the insulation housing 4 and the plug shell 1 are assembled, the body portion 40 of the insulation housing 4 is installed into the accommodating space 13 of the plug shell 1 via the accommodating opening 15. When the body portion 40 is completely accommodated inside the accommodating space 13, the window flange 41 of the insulation housing 4 is able to cover the front edge 14 of the plug shell 1, so as to prevent the front edge 14 of the plug shell 1 from exposure and further to achieve apparent requirement of products. Furthermore, an engaging slot 404 is formed on the body portion 40, and the plug shell 1 has an engaging protrusion 101 formed on the main body 10. When the body portion 40 is completely accommodated in the accommodating space 13, the engaging protrusion 101 is engaged in the engaging slot 404 for preventing the body portion 40 of the insulation housing 4 from separating from the accommodating space 13 of the plug shell 1. In this embodiment, the engaging protrusion 101 is a bending structure and integrally formed with the plug shell 1, but the present invention is not limited thereto.

As shown in FIG. 2 to FIG. 5, the plug contacts 3' includes a main body 30, a foot portion 31, a first end portion 32, a second end portion 33, a first spring arm 34 and a second spring arm 35. The foot portion 31 extends from the main body 30. The first spring arm 34 connects the first end portion 32 and the main body 30, such that the first end portion 32 is resiliently connected to the main body 30. The second spring arm 35 connects the second end portion 33 and the main body 30, such that the second end portion 33 is resiliently connected to the main body 30. In other words, the first end portion 32 of the plug contacts 3' is resiliently connected to the main body 30 by the first spring arm 34, and the second end portion 33 is resiliently connected to the main body 30 by the second spring arm 35 i.e., the first end portion 32, the first spring arm 34, the second end portion 33, the second spring arm 35 and the main body 30 of the plug contacts 3' of the present invention is a substantially fork-shaped structure. Furthermore, an assembling slot 202 is formed on the main base 20 of the housing base 2. A first slot 2101 is formed on the first face 210 of the tongue structure 21 of the housing base 2, and a second slot 2110 is formed on the second face 211 of the tongue structure 21 of the housing base 2. The assembling slot 202 communicates with the first slot 2101 and the second slot 2110.

As shown in FIG. 4 and FIG. 5, when the plug contacts 3' and the housing base 2 are assembled, the plug contacts 3' is inserted into the assembling slot 202 on the main base 20 from a rear side of the housing base 2 until the main body 30 of the plug contacts 3' is installed in the main base 20 of the housing base 2. During the above-mentioned process, the first end portion 32 of the plug contact set 3 stretches out of a front side 212 of the tongue structure 21 via the first face 210 of the tongue structure 21, and the first spring arm 34 of the plug contacts 3' is disposed in the first slot 2101 on the first face 210 of the tongue structure 21. The second end portion 33 of the plug contact set 3 stretches out of the front side 212 of the tongue structure 21 via the second face 212 of the tongue structure 21, and the second spring arm 35 of the plug contacts 3' is disposed in the second slot 2110 on the second face 211 of the tongue structure 21.

In such a manner, during the process that the main body 30 of the plug contacts 3' is installed in the main base 20 of the housing base 2, the fork structure that the first end portion 32, the first spring arm 34, the second end portion 33, the second spring arm 35 and the main body 30 of the plug contacts 3' are integrally formed allows the first spring arm 34 and the second spring arm 35 to be respectively disposed in the first slot 2101 and the second slot 2110, and the aforesaid fork structure further allows the first end portion 32 and the second end portion 33 to stretch out of the front side 212 of the tongue structure 21 and face each other. Furthermore, after the main body 30 is completely installed in the assembling slot 202 on the main base 20, the foot portion 31 stretches out of the main base 20 from a rear side of the main base 20 for facilitating the foot portion 31 to be welded onto an electronic component, such as a circuit board or a cable.

In this embodiment, it should be noticed that the two adjacent foot portions 31 are respectively corresponding to the first face 210 and the second face 211, as shown in FIG. 2 and FIG. 3. In other words, the two adjacent foot portions 31 of the plug contacts 3' of the present invention are staggered, such that the two adjacent foot portions 31 are able to be welded onto pads on opposite sides of the circuit board, respectively. In such a manner, the pads of the circuit board are able to be arranged on the two opposite sides of the circuit board, so as to prevent from a narrow pitch resulting from the pads being disposed on the same side. In addition, the main body 30 of the port contact 3' includes at least one engaging spur 301 selectively disposed on one side or two opposite sides of the main body 30. When the main body 30 is installed inside the assembling slot 202 on the main base 20, the engaging spur 301 engages with a lateral wall of the assembling slot 202. In such a way, it prevents the port contact 3' from being pushed by the port connector when the port connector mates with the plug connector 3000, so as to prevent the plug contact 3' from being removed from the assembling slot 202. The number and the configuration of the engaging spur 301 are not limited to those illustrated in the figures in this embodiment, and it depends on practical demands.

Figure 6:
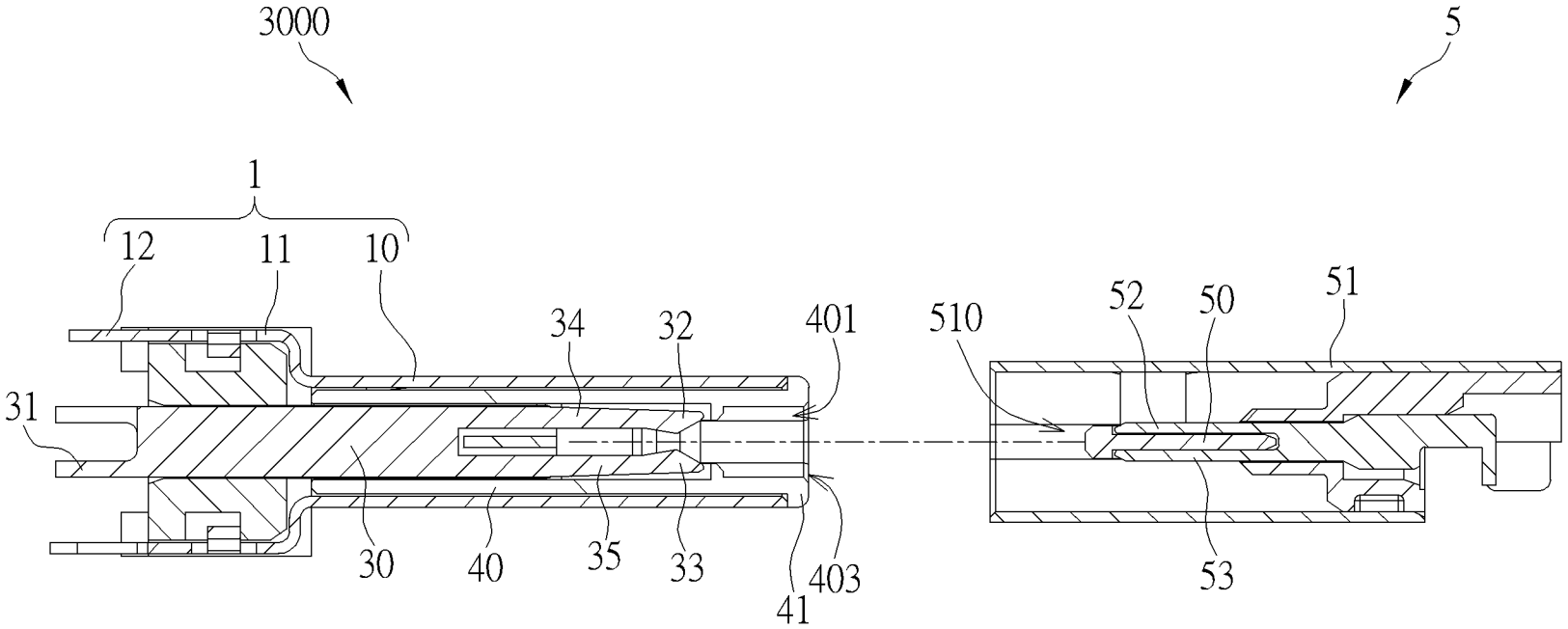
FIG. 6 is an exploded diagram of the plug connector in the non-mated status and at another view according to the first embodiment of the present invention.

Please refer to FIG. 4 and FIG. 6. FIG. 6 is an exploded diagram of the plug connector 3000 in the non-mated status and at another view according to the first embodiment of the present invention. As shown in FIG. 4 and FIG. 6, a partition structure 213 is defined by a bottom surface S1 of the first slot 2101 and a bottom surface S2 of the second slot 2110 of the tongue structure 21 as well as a lateral wall S3 of the assembling slot 202 of the main base 20. A clamping slot 36 is defined between the first spring arm 34 and the second spring arm 35. After the plug contacts 3' is installed with the housing base 2, the clamping slot 36 clamps the partition structure 213. In such a manner, the partition structure 213 provides the first spring arm 34 and the second spring arm 35 of the plug contacts 3' with a stop, so as to stop the first end portion 32 and the second end portion 33 from over deformation during mating, which enhances life of plug connector 3000.

Figure 7:
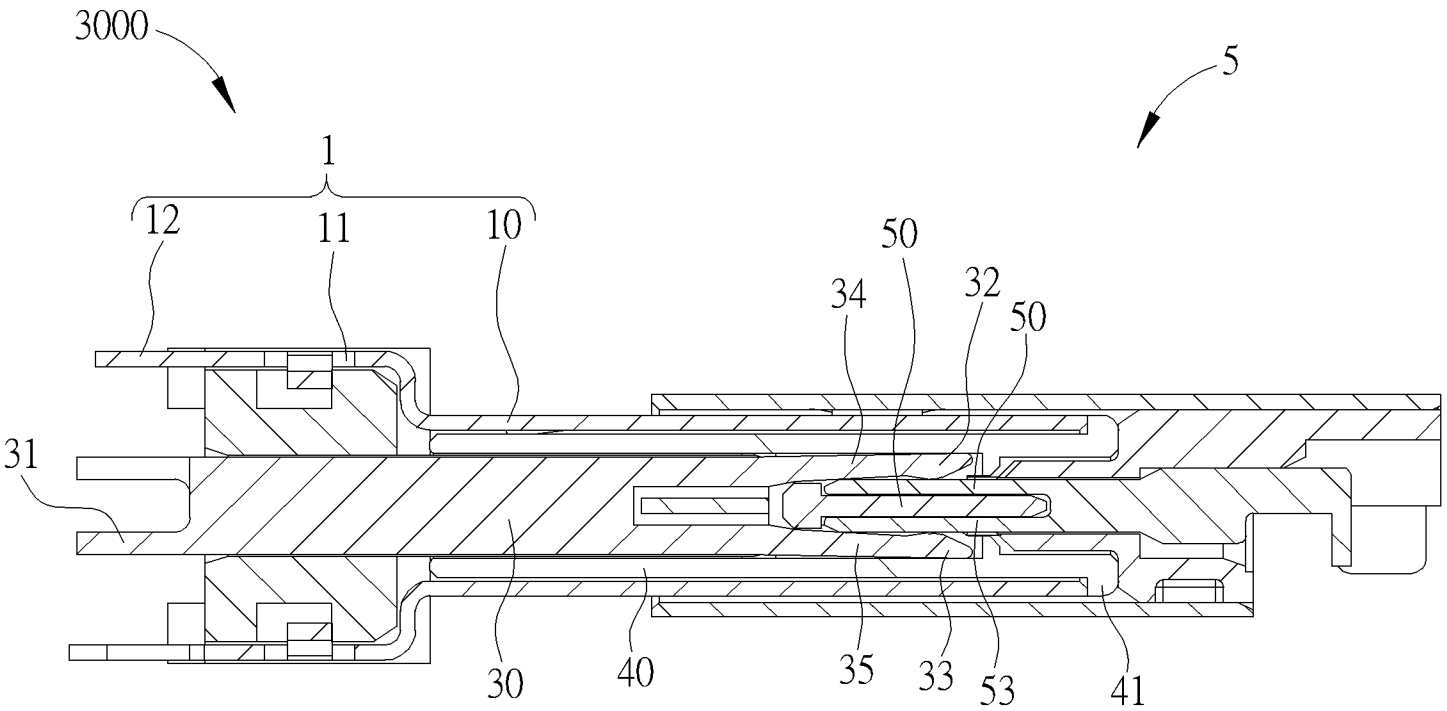
FIG. 7 is an exploded sectional diagram of the plug connector in the non-mated status according to the first embodiment of the present invention.

As shown in FIG. 2, FIG. 3 and FIG. 5, a resiliently engaging arm 405 is formed on the body portion 40 of the insulation housing 4. In practical application, the body portion 40 and the resiliently engaging arm 405 are integrally formed. When the plug connector 3000 of the present invention mates with a port connector 5 shown in FIG. 5, the resiliently engaging arm 405 is for resiliently engaging with an engaging block 501 of a tongue structure 50 of the port connector 5, such that the plug connector 3000 is stably mated with the port connector 5. Please refer to FIG. 6 and FIG. 7. FIG. 7 is an exploded sectional diagram of the plug connector 3000 in the non-mated status according to the first embodiment of the present invention. As shown in FIG. 6 and FIG. 7, an external socketing space 510 is surrounded by a port shell 51 of the port connector 5, and the external socketing space 510 communicates with exterior of the port connector 5 via a socketing opening 511. Accordingly, the plug connector 3000 is able to be mated inside the external space 510.

During the process that the plug connector 3000 moves from the position shown in FIG. 6 to the position shown in FIG. 7, the first end portion 32 of the plug contact 3' abuts against a front portion of the tongue structure 50 of the port connector 5 first, resulting in deformation of the first spring arm 34, which allows the first end portion 32 to pass the front portion of the tongue structure 50 of the port connector 5 and abut against an upper row of contacts 52 of the port connector 5. Meanwhile, the first spring arm 34 drives the first end portion 32 to press on the upper row of contacts 52. In such a manner, the first end portion 32 of the plug contact 3' is able to be electrically coupled to the upper row of contacts 52 of the port connector 5. Similarly, the second end portion 33 of the plug contact 3' abuts against the front portion of the tongue structure 50 of the port connector 5 first, resulting in deformation of the second spring arm 35, which allows the second end portion 33 to pass the front portion of the tongue structure 50 of the port connector 5 and abut against a lower row of contacts 53 of the port connector 5. Meanwhile, the second spring arm 35 drives the second end portion 33 to press on the lower row of contacts 53. In such a manner, the second end portion 33 of the plug contact 3' is able to be electrically coupled to the lower row of contacts 53 of the port connector 5.

Since the first end portion 32 is symmetric to the second end portion 33 in the present invention, when the plug connector 3000 mates with the port connector 5 reversely, i.e., the plug connector 3000 is turned over so that the first end portion 32 is oriented downwards and the second spring arm 35 is oriented upwards, the first end portion 32 is able to abut and press on the lower row of contacts 53, and the second end portion 33 is able to abut and press on the upper row of contacts 52. In such a way, the plug connector 3000 of the present invention is able to be mated with the port connector 5 reversely. It should be noted that one of the plug contact 3' (e.g. the signal detecting contact) of the plug contact set 3 of the port connector 3000 of the present invention is for detecting orientation that the port connector 5 mates with the plug connector 3000. The present invention further utilizes a control unit (not shown in figures) to configure pin definition of the plug contact set 3 of the plug connector 3000 for matching the orientation that the port connector 5 mates with the plug connector 3000. In such a manner, the plug connector 3000 of the present invention has capability of dual mating orientation.

Figure 8:
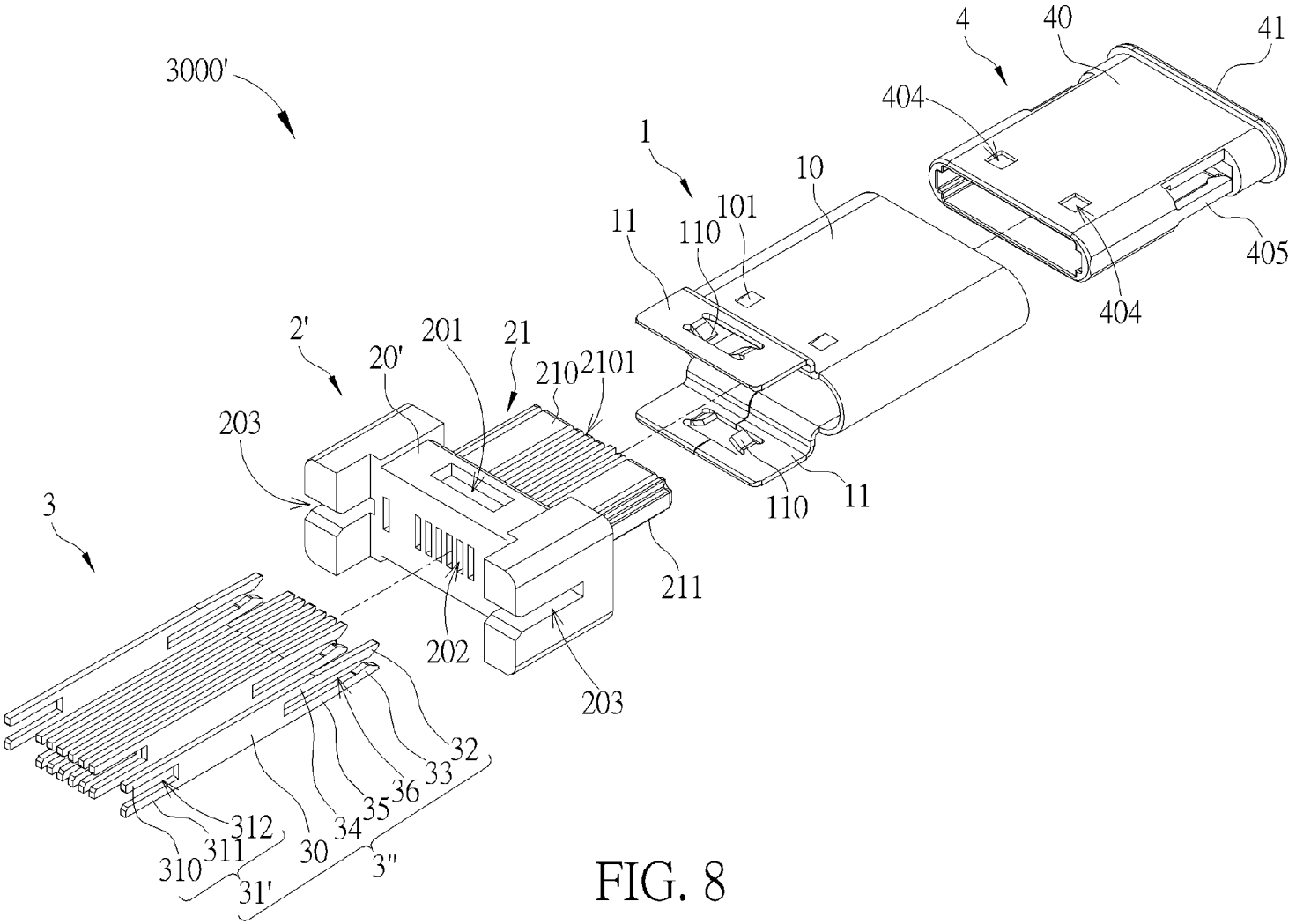
FIG. 8 is an exploded diagram of a plug connector according to a second embodiment of the present invention.

Please refer to FIG. 8. FIG. 8 is an exploded diagram of a plug connector 3000' according to a second embodiment of the present invention. As shown in FIG. 8, the main difference between the plug connector 3000' and the aforesaid plug connector 3000 is that each foot portion 31' of a plug contact 3' of the plug connector 3000' includes a first pin 310 and a second pin 311, and a pin slot 312 is defined between the first pin 310 and the second pin 311. When the plug connector 3000' is disposed on an edge of the circuit board, the pin slot 312 is for clamping the edge of the circuit board, so as to fix the plug connector 3000' and the circuit board. In addition, a base slot 203 is formed on a main base 20' of a housing base 2' of the plug connector 3000' and is located corresponding to the pin slot 312. The base slot 203 and the pin slot 312 cooperatively clamp the edge of the circuit board, such that the plug connector 3000' is able to be fixed on the circuit board more stably.

Figure 9:
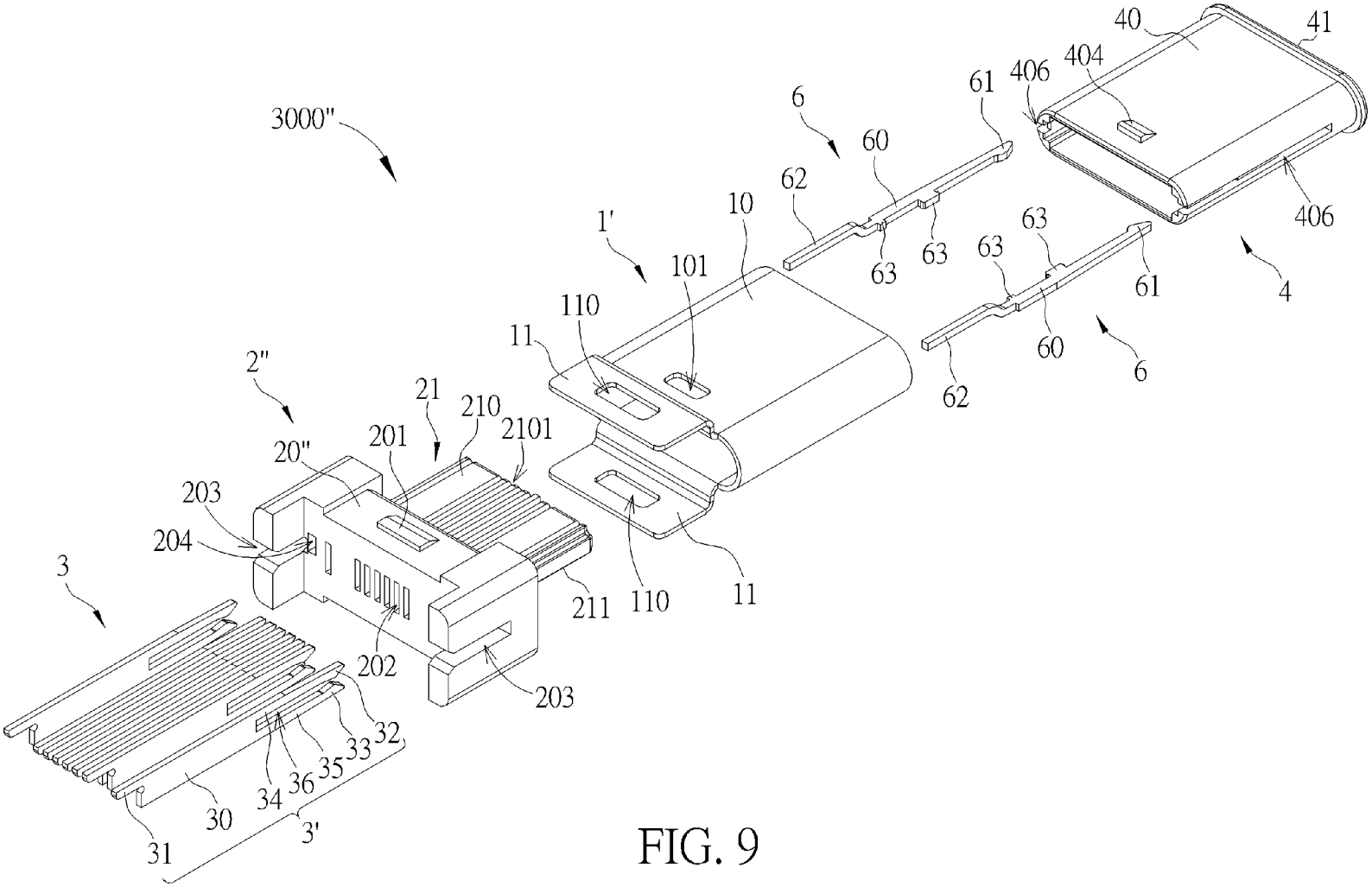
FIG. 9 is an exploded diagram of a plug connector according to a third embodiment of the present invention.
Figure 10:
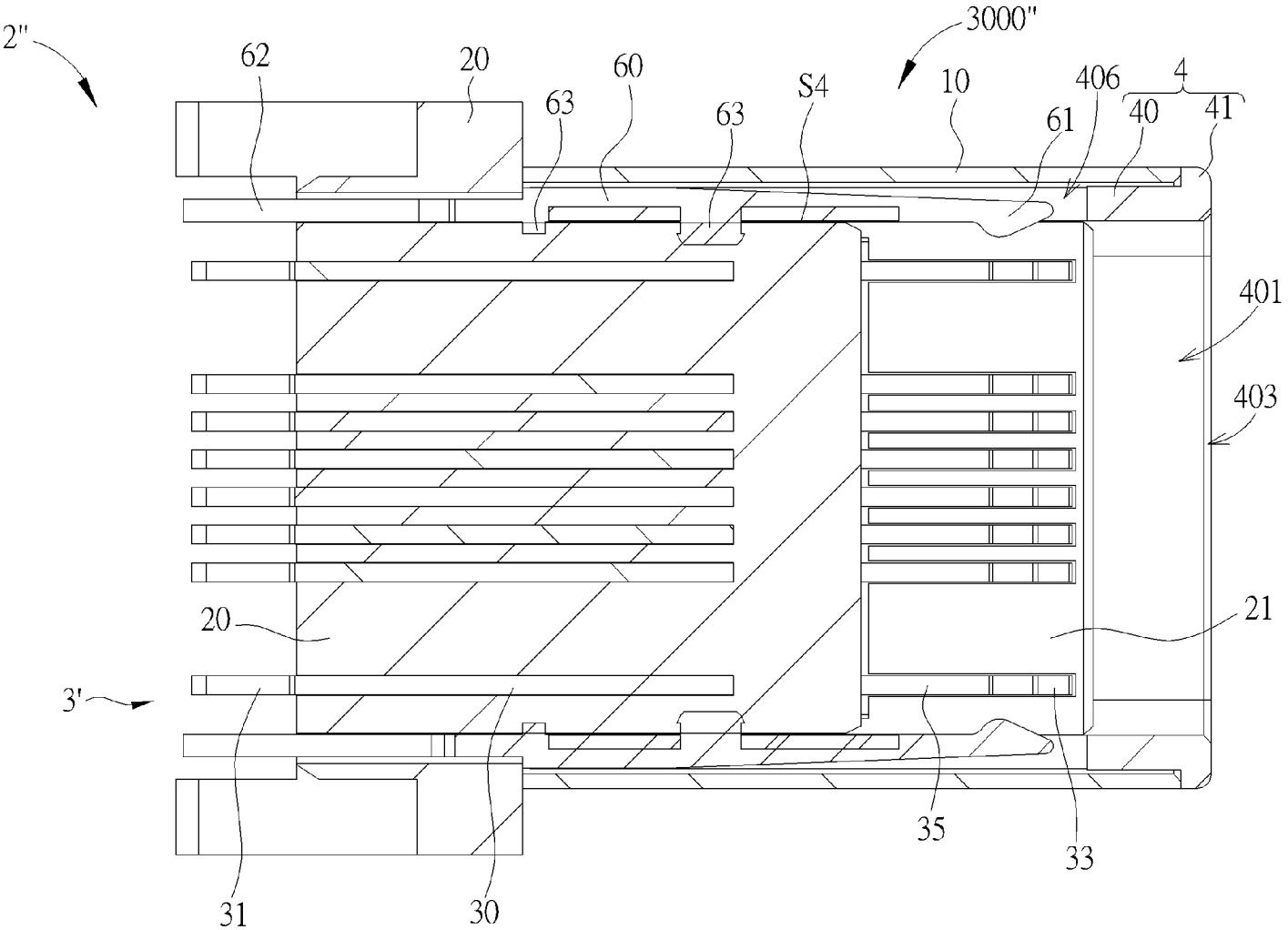
FIG. 10 is a sectional diagram of the plug connector according to the third embodiment of the present invention.

Please refer to FIG. 9 and FIG. 10. FIG. 9 is an exploded diagram of a plug connector 3000" according to a third embodiment of the present invention. FIG. 10 is a sectional diagram of the plug connector 3000" according to the third embodiment of the present invention. As shown in FIG. 9 and FIG. 10, the main difference between the plug connector 3000' and the aforesaid plug connector 3000' is that the plug connector 3000" further includes a resiliently engaging member 6 instead of the resiliently engaging arm integrally formed with the insulation housing 4. A housing assembling slot 406 is formed on a body portion 40' of an insulation housing 4', and the resiliently engaging member 6 is installed in the housing assembling slot 406. Furthermore, a through slot 204 is formed on a main base 20" of a housing base 2" of the plug connector 3000", and the resiliently engaging member 6 includes an engaging body 60, an engaging portion 61, a fixing portion 62 and two embedding structures 63. The embedding structures 63 protrude from the engaging body 60, respectively. The embedding structures 63 is for embedding a lateral wall S4 of the housing assembling slot 406, as shown in FIG. 10, for fixing the engaging body 60 in the housing assembling slot 406.

Furthermore, the engaging portion 61 extends from the engaging body 60 and is resilient with respect to the engaging body 60, such that the engaging portion 61 is able to engage with the engaging block 501 of the tongue structure 50 of the port connector 5, as shown in FIG. 5. In this embodiment, it should be noticed that the fixing portion 62 extends from the engaging body 60 and located opposite to the engaging portion 61, i.e., the fixing portion 62 and the engaging portion 61 extend from two opposite sides of the engaging body 60. During the resiliently engaging member 6 is assembled with the housing base 2', the fixing portion 62 of the resiliently engaging member 6 passes through the main base 20" via the through slot 204 on the main base 20", and protrudes from the side of the main base 20" the same as the foot portion 31' of the plug contact 3'. As a result, the fixing portion 62 of the resiliently engaging member 6 is able to be welded on the circuit board with the foot portion 31' of the plug contact 3' for enhancing connectivity between the plug connector 3000" and the circuit board. It should be noticed that a plug shell 1' of the plug connector 3000" is integrally formed in a metal injection molding manner or in a zinc alloy die manner for excluding a dovetail groove, so as to achieve apparent requirement of the plug shell 1' of the plug connector 3000".

Figure 11:
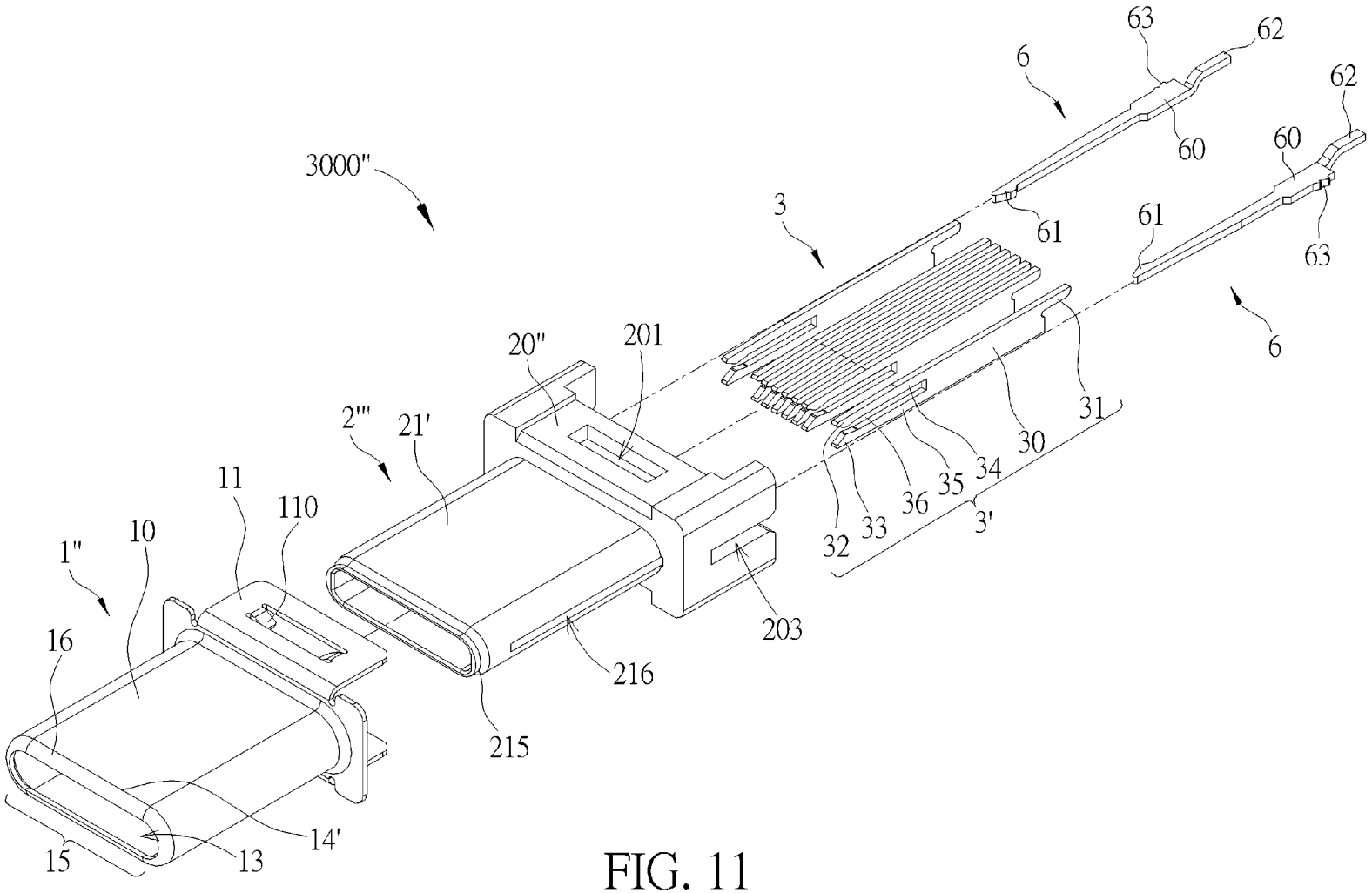
FIG. 11 is an exploded diagram of a plug connector according to a fourth embodiment of the present invention.
Figure 12:
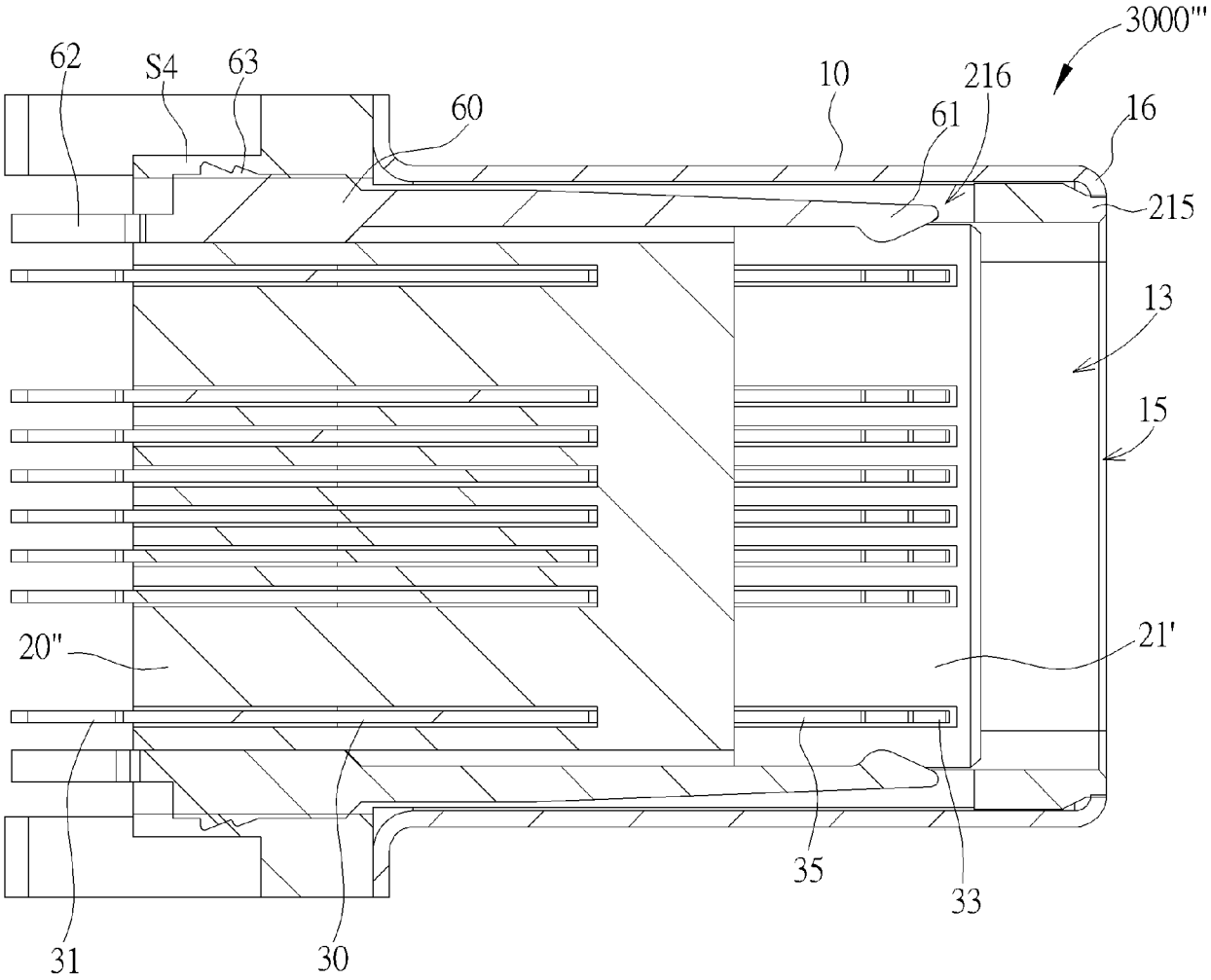
FIG. 12 is a sectional diagram of the plug connector according to the fourth embodiment of the present invention.

Please refer to FIG. 11 and FIG. 12. FIG. 11 is an exploded diagram of a plug connector 3000'" according to a fourth embodiment of the present invention. FIG. 12 is a sectional diagram of the plug connector 3000'" according to the fourth embodiment of the present invention. As shown in FIG. 11 and FIG. 12, the main difference between the plug connector 3000'" and the aforesaid plug connector 3000" is that a plug shell 1" of the plug connector 3000'" is integrally formed in a draw manner. As a result, an opening flange 16 is formed on a front edge 14' of the plug shell 1" during the drawn process. The opening flange 16 is for covering an edge 215 of a tongue structure 21' of housing base 2'" of the plug connector 3000'", so as to prevent the edge 215 of the tongue structure 21' from exposure and further to achieve apparent requirement of product. In addition, the insulation housing of the plug connector 3000'" and the housing base 2'" can be integrally formed. As a result, a tongue assembling slot 216 for assembling the resiliently engaging member 6 can be formed on the tongue structure 21' of the plug connector 3000'". Components with denoted in this embodiment identical to those in the aforesaid embodiment have identical structures and functions, and further description is omitted herein for simplicity.

Compared to the prior art, the main body, the first spring arm, the first end portion, the second spring arm and the second end portion of the plug contact of the present invention are an integrally-formed fork structure. Accordingly, when the port contact is mounted with the housing base, the first end portion and the second end portion of the plug contact respectively stretch out of the tongue structure of the housing base and face to each other, such that the plug connector of the present invention is capable of dually mating with an external connector for enhancing convenience in use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A plug connector with capability of dual mating orientation, comprising:

a plug shell;

a housing base combined with the plug shell, the housing base comprising a main base and a tongue structure, the tongue structure extending from the main base and having a first face and a second face opposite to the first face; and a plug contact set mounted with the housing base, at least one of the plug contact set comprising:

a main body installed inside the main base;

a foot portion extending from the main body and stretching out of the main base;

a first end portion resiliently connected to the main body and stretching out of the tongue structure via the first face; and a second end portion corresponding to the first end portion, resiliently connected to the main body and stretching out of the tongue structure via the second face.

2. The plug connector of claim 1, wherein an accommodating space is surrounded by the plug shell, an accommodating opening is defined by a front edge of the plug shell, the plug connector further comprises an insulation housing disposed inside the plug shell, and the insulation housing comprises:

a body portion installed in the accommodating space via the accommodating opening, an inner socketing space being surrounded by the body portion, the inner socketing space accommodating the tongue structure and the plug contact set, an edge of the body portion defining a window; and a window flange disposed on the edge of the body portion and protruding from the window, the window flange covering the front edge of the plug shell.

3. The plug connector of claim 2, wherein a resiliently engaging arm is formed on the body portion, the resiliently engaging arm engages with a port connector, and the body portion and the resiliently engaging arm are integrally formed.

4. The plug connector of claim 2, wherein a housing assembling slot is formed on the body portion, and the plug connector further comprises:

a resiliently engaging member installed in the housing assembling slot and resiliently engaging with a port connector.

5. The plug connector of claim 4, wherein a through slot is formed on the main base, and the resiliently engaging member comprises:

an engaging body mounted in the housing assembling slot;

an engaging portion extending from the engaging body and engaging with the port connector; and a fixing portion extending from the engaging body and located opposite to the engaging portion, the fixing portion passing through the main base via the through slot, stretching out of the main base and located on the same side with the foot portion.

6. The plug connector of claim 5, wherein the resiliently engaging member further comprises:

at least one embedding structure protruding from the engaging body and embedding in a lateral wall of the housing assembling slot.

7. The plug connector of claim 2, wherein an engaging slot is formed on the body portion, the plug shell has an engaging protrusion, and the engaging protrusion is engaged in the engaging slot.

8. The plug connector of claim 2, wherein the plug shell is integrally formed in a metal injection molding manner or in a zinc alloy die manner.

9. The plug connector of claim 1, wherein the plug shell is integrally formed in a draw manner, an accommodating space is surrounded by the plug shell and accommodates the housing base and the tongue structure, an accommodating opening is defined by a front edge of the plug shell, an opening flange is formed on the front edge of the plug shell and covers an edge of the tongue structure of the housing base.

10. The plug connector of claim 9, wherein a tongue assembling slot is formed on the tongue structure of the housing base, and the plug connector further comprises:

a resiliently engaging member installed in the tongue assembling slot and resiliently engaging with a port connector.

11. The plug connector of claim 10, wherein a passage is formed on the main base and communicates with the tongue assembling slot, and the resiliently engaging member comprises:

an engaging body mounted in the tongue assembling slot;

an engaging portion extending from the engaging body and engaging with the port connector; and a fixing portion extending from the engaging body and located opposite to the engaging portion, the fixing portion passing through the main base via the passage, stretching out of the main base and located on the same side with the foot portion.

12. The plug connector of claim 11, wherein the resiliently engaging member further comprises:

at least one embedding structure protruding from the engaging body and embedding in a lateral wall of the tongue assembling slot.

13. The plug connector of claim 1, wherein an assembling slot is formed on the main base, the main body is installed in the assembling slot, a first slot is formed on the first face of the tongue structure, a second slot is formed on the second face of the tongue structure, the assembling slot communicates with the first slot and the second slot, and the at least one plug contact comprises:

a first spring arm connecting the first end portion and the main body, the first spring arm being disposed in the first slot; and a second spring arm connecting the second end portion and the main body, the second spring arm being disposed in the second slot.

14. The plug connector of claim 13, wherein a partition structure is defined by a bottom surface of the first slot, a bottom surface of the second slot and a lateral wall of the assembling slot, a clamping slot is defined between the first spring arm and the second spring arm, when the main body is installed in the assembling slot, the first spring arm enters and is accommodated in the first slot via the assembling slot, the second spring arm enters and is accommodated in the second slot via the assembling slot, and the clamping slot clamps the partition structure.

15. The plug connector of claim 13, wherein the main body has at least one engaging spur, and the at least one engaging spur engages with a lateral wall of the assembling slot when the main body is installed in the assembling slot.

16. The plug connector of claim 15, wherein the at least one embedding structure is selectively disposed on a side of the main body or on two opposite sides of the main body.

17. The plug connector of claim 1, wherein the plug shell has a fixing lug whereon an engaging structure is formed, a holding structure is formed on the main base of the housing base, and the engaging structure engages with the holding structure.

18. The plug connector of claim 17, wherein the two adjacent foot portions are respectively corresponding to the first face and the second face of the tongue structure, the plug shell further has a fixing pin protruding from the fixing lug, and the fixing pin and each of the foot portions are respectively fixed on a circuit board.

19. The plug connector of claim 1, wherein each of the foot portions comprises a first pin and a second pin, a pin slot is defined between the first pin and the second pin, and the pin slot clamps an edge of a circuit board.

20. The plug connector of claim 19, wherein a base slot is formed on the main base of the housing base, and the base slot and the pin slot cooperatively clamp the edge of the circuit board.

* * * * *